US007849541B2

(12) United States Patent
Gauger

(10) Patent No.: US 7,849,541 B2
(45) Date of Patent: Dec. 14, 2010

(54) BED WITH RIGID PLATFORM AND FLUID SUSPENSION

(76) Inventor: Derek K. Gauger, P.O. Box 5636, Berkeley, CA (US) 94705

( * ) Notice: Subject to any disclaimer, the term of this patent is extended or adjusted under 35 U.S.C. 154(b) by 0 days.

(21) Appl. No.: 12/366,732

(22) Filed: Feb. 6, 2009

(65) Prior Publication Data

US 2009/0193580 A1 Aug. 6, 2009

Related U.S. Application Data

(60) Provisional application No. 61/026,519, filed on Feb. 6, 2008.

(51) Int. Cl.
*A47C 27/08* (2006.01)

(52) U.S. Cl. ..... 5/678; 5/679; 5/665; 5/728; 5/400

(58) Field of Classification Search ..... 5/241, 5/244, 118, 104, 659, 691, 701, 665, 678–680, 5/685, 686, 400, 728, 721, 655.3
See application file for complete search history.

(56) References Cited

U.S. PATENT DOCUMENTS

| | | | | | |
|---|---|---|---|---|---|
| 3,299,447 | A * | 1/1967 | Dome | ..... | 5/118 |
| 3,736,604 | A * | 6/1973 | Carson, Jr. | ..... | 5/422 |
| 5,311,623 | A * | 5/1994 | Hendi | ..... | 5/685 |
| 5,524,307 | A * | 6/1996 | Griffin | ..... | 5/710 |
| 5,564,141 | A * | 10/1996 | Anderson | ..... | 5/668 |
| 7,401,368 | B1 * | 7/2008 | Saucedo | ..... | 5/118 |

* cited by examiner

*Primary Examiner*—Michael Trettel
(74) *Attorney, Agent, or Firm*—Young & Basile

(57) ABSTRACT

A bed mattress support apparatus and method includes a fluid filled bladder or multiplicity of bladders to vertically support a rigid platform. The rigid platform provides a suspended surface to support a mattress, foam pad, or other mattress-like device. A frame surrounds the bladder to prevent lateral movement of the bladder. Motion limiting features control vertical displacement of the platform.

26 Claims, 7 Drawing Sheets

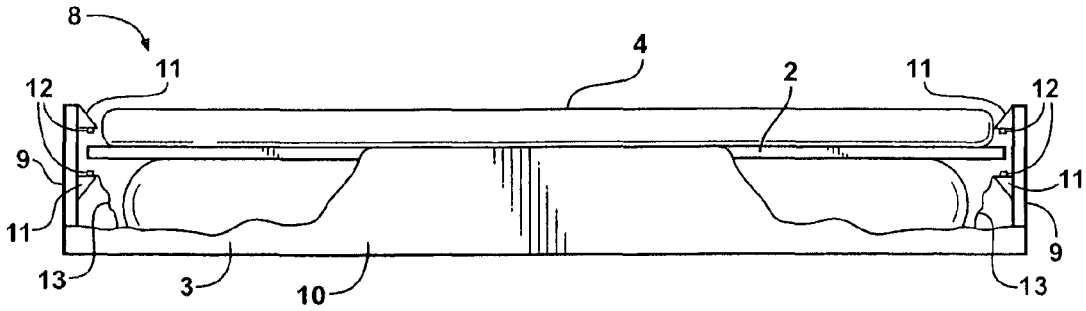
FIG. 10
FIG. 11
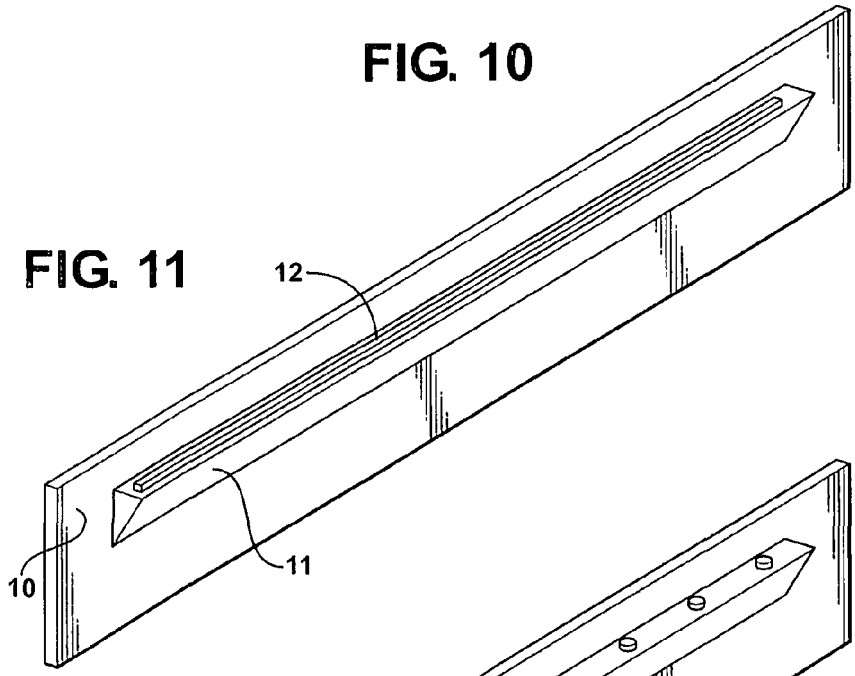
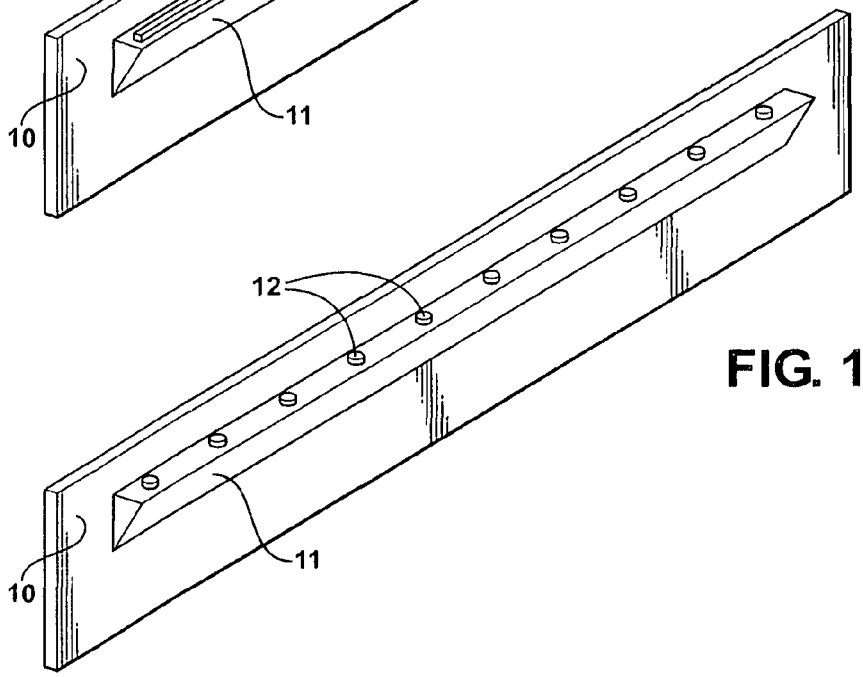
FIG. 12

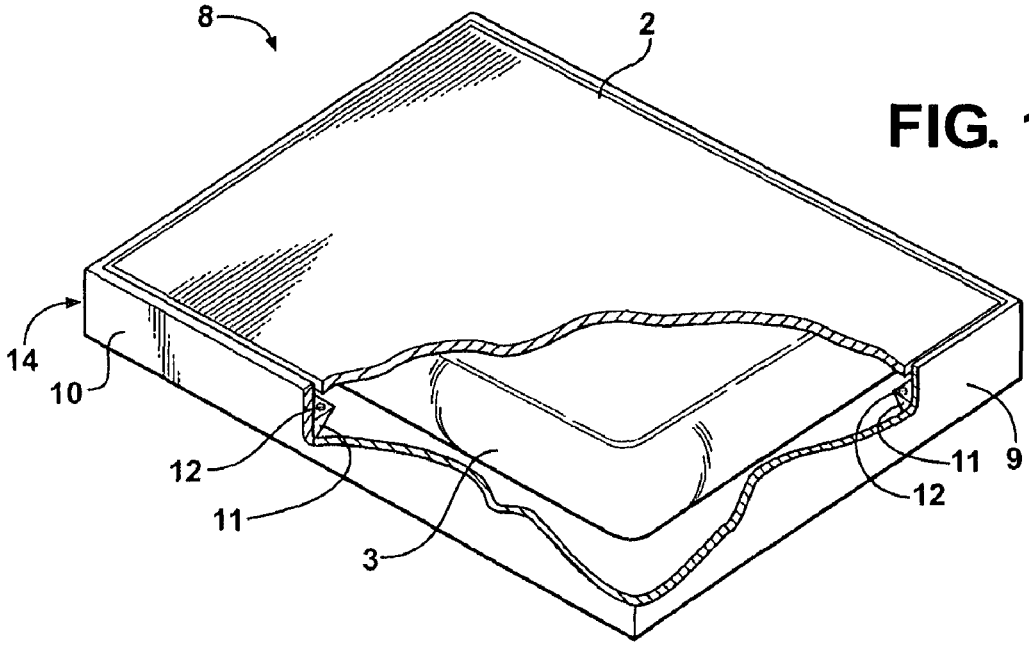
FIG. 13
FIG. 14
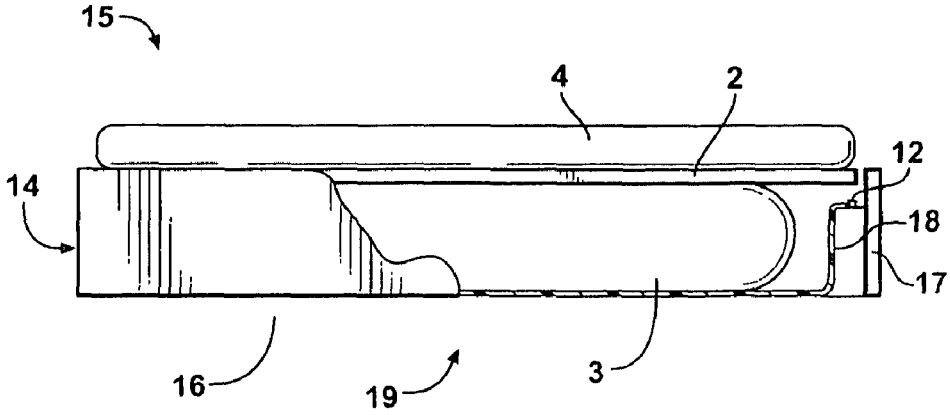

BED WITH RIGID PLATFORM AND FLUID SUSPENSION

CROSS-REFERENCE TO CO-PENDING APPLICATION

This application claims priority to the benefit of the Feb. 6, 2008 filing date of U.S. Provisional Patent Application Ser. No. 61/026,519, for "A Bed with Rigid Platform and Fluid Suspension", the entire contents of which are incorporated herein by reference.

BACKGROUND

Waterbeds, water mattress beds, and soft-sided waterbeds use a water bladder or a multiplicity of water tubes to provide compliant and body form fitting support while a person is sitting or lying on the water mattress. Additionally water mattresses provide varying degrees of wave motion when a person or persons move on the bed such as when they roll over from one side to the other while sleeping. These are all desirable attributes to encourage restful and comfortable sleep.

Other mattress designs, or standard mattresses, that do not use water employ foam, springs, memory foam, latex, and other compliant materials. Typically, these mattress designs are preferred by the majority of the population and specifically by those who either do not like the wave motion of water mattresses or are bothered with the nature of such mattresses characterized by sagging or lack of firmness. Often, people complain of back pain after sleeping on a water mattress especially if they prefer to sleep on their stomach and to some extent if they sleep on their side.

These standard mattresses have several compromises in achieving a device to provide comfortable and restful sleep to many. Specifically, there always exists a compromise between support and comfort. To achieve a higher level of comfort, designers make the mattress more compliant with softer foam, more compliant springs, soft "toppers" made of softer foam, and other methods. To achieve a higher level of support, designers increase the spring rate, durometer of the foam, avoid soft toppers, and other methods. This compromise affects those people the most who tend to prefer a stiffer mattress. Typically, these people are people who sleep on their stomachs or their sides. The resulting situation is one in which the mattress and bed system is non-compliant to motions and changes of position during the sleeping period. When such a motion takes place, the non-compliancy of the mattress support system often causes the sleeping person to awake partially or fully.

Many innovations and design trends in the mattress and sleep industry have tried to overcome this dilemma. In particular and recently, manufacturers are offering memory foam mattresses, air mattresses that are adjustable to an individual's need for compliancy, latex foam mattresses, a variety of different mattress toppers of many different materials, and others. None of these addresses the need for a mattress that is firm for proper support and has compliance to lessen the detrimental effect caused by the support system not reacting to motions and body position changes.

What is needed is a mattress and support system that allows for any type of mattress, mattress firmness, and comfort level and that also provides compliancy such that it provides a shock and force absorbing motion when a person changes position during sleep.

SUMMARY

A bed mattress support apparatus and method includes a fluid filled bladder or multiplicity of bladders to vertically support a rigid platform. The rigid platform provides a suspended surface to support a mattress, foam pad, or other mattress like device.

Several aspects of each of the features of the disclosed mattress support apparatus and method are possible. One aspect employs a single water filled bladder typically made from a flexible plastic film such as a bladder used in waterbed mattresses. The fluid filled bladder may be constructed of other flexible materials and may be filled with other fluids than water. Additionally, the suspension component may be a multiplicity of smaller bladders such as tubes.

The mattress support apparatus and method employs a frame that is functional and may be decorative as well. The design of this frame has infinite different configurations and many different material options; but one aspect includes first and second end panels and first and second side panels. Each of these end and side panels also includes a vertical motion limiting device to prevent the rigid platform and the mattress from excessive vertical movement.

The apparatus may also employ either a rigid tray or flexible membrane to provide flooding protection in the event that the bladder ruptures.

The rigid platform may also be constructed of many different materials and may have many different design configurations such as a homogeneous flat panel, honeycomb sandwich construction, other composite constructions, and other stiffening element designs.

Additionally, the mattress support apparatus and method is applicable to a design for a baby's or child's crib. The same construction methods and design elements apply.

The disclosed mattress support apparatus and method provide for a person's choice of mattress, mattress firmness, and mattress comfort characteristics while also providing for compliancy to motions of the sleeping or resting person. Additionally, this compliance provides wave like motions during and after such motions.

BRIEF DESCRIPTION OF THE DRAWING

The various features, advantages, and other uses of the present mattress support apparatus will become more apparent by referring to the following detailed description and drawing in which:

FIG. 10 is a side cutaway view of the mattress support apparatus with double motion limiters, with a frame and a single bladder FIG. 11 is a perspective view of an end panel with a vertical motion limiting stop;

FIG. 12 is a perspective view of an end panel with a vertical motion limiting stop;

FIG. 13 is a perspective and cutaway view of the mattress support apparatus with a frame and a single bladder;

FIG. 14 is a front cutaway view of the mattress support apparatus with a single bladder, and a frame with an integrated flood protection tray;

DETAILED DESCRIPTION

Figure 1:
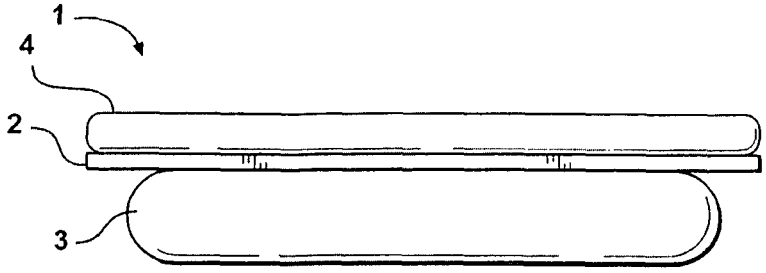
FIG. 1 is a front elevational view of the mattress support apparatus without a frame and with a single bladder.
Figure 2:
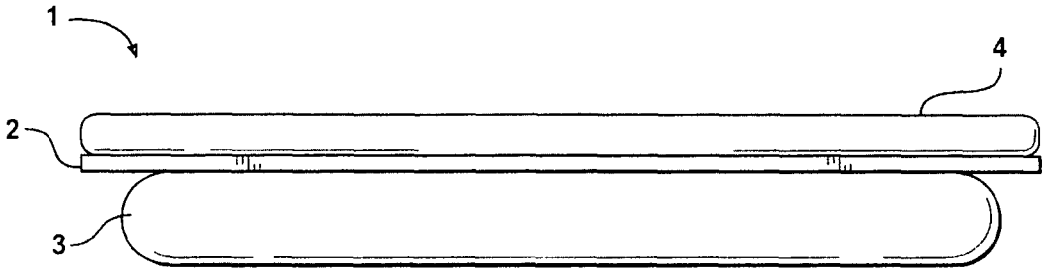
FIG. 2 is a side elevational view of the mattress support apparatus without a frame and with a single bladder.
Figure 3:
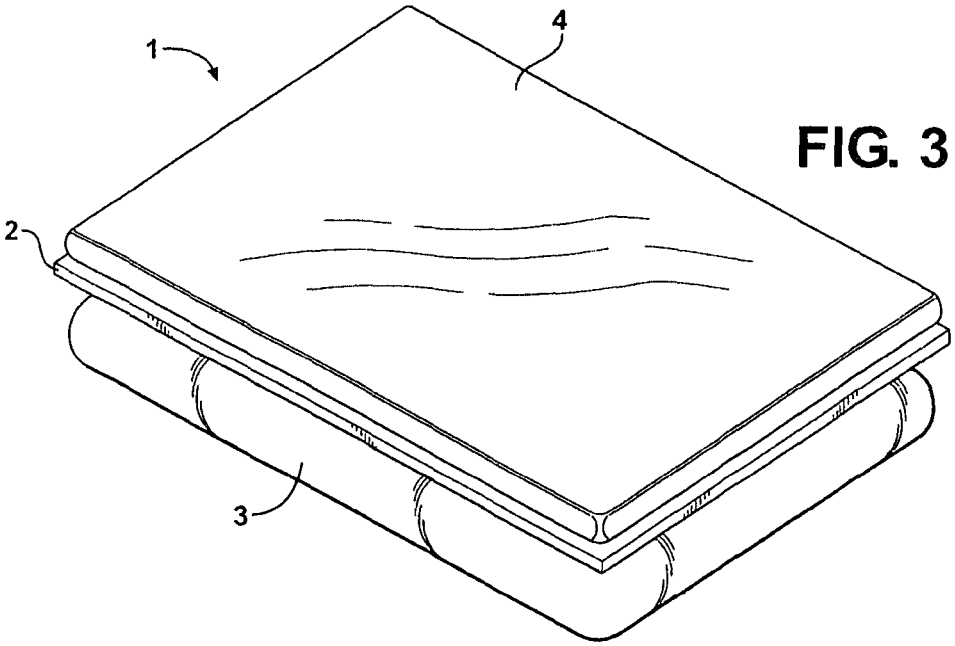
FIG. 3 is a perspective view of the mattress support apparatus without a frame and with a single bladder.

Referring to FIGS. 1-18 of the drawing and to FIGS. 1-3 in particular, there is depicted a bed mattress support apparatus 1 that employs a bladder 3 for containment of a fluid, a substantially rigid platform 2 disposed on top of the bladder 3, and an optional cushion 4, such as a standard bed mattress, an air mattress, or other similar device, such as a foam pad or a pillow.

The platform 2 may be constructed of any material and design that results in a rigid or semi-rigid flat panel that does not have excessive or noticeable flexure when a load approximating a sleeping person or persons is applied to it. Many different materials and construction methods will achieve this requirement. These include, but are not limited to, plywood, particle board, medium density and other fiberboards, fiberglass, carbon fiber, plastics, steel, aluminum, other metals, and composite sandwich constructions with any of these same materials combined with any of the same materials or others, such as cardboard, honeycomb material, etc. The platform 2 may have a solid construction, a honeycomb construction, and it can be formed of a single piece or multiple joined pieces.

The bladder or membrane 3 is constructed of a semi-rigid or flexible film material, such as vinyl, for example, that is formed into a three dimensional rectangular shaped, closed vessel that contains a liquid. It is understood that other shapes, sizes, and materials such as polyethylene, polypropylene, polyvinyl chloride, etc., are possible. The bladder 3 also has an opening, not shown, that is closable in order to allow for the filling and draining of the fluid. The fluid contained by the bladder 3 is typically water; although other fluids are possible, such as air, various types of oil, salt water, oil and water mixtures, liquid foams, emollients, etc.

The bladder 3 and the platform 2 disposed on the top of the bladder 3 provide a compliant support or suspension while maintaining a rigid platform for a mattress 4 in which movements by a sleeping person or persons create motion of the platform 2 and mattress 4 relative to the surface on which the bladder 3 is placed or mounted. These motions are similar to typical waterbed and soft-sided waterbed motions in that a force from a moving person causes volumetric displacement of the bladder 3 fluid from one area to another area of the bladder 3. However, the motion that the sleeping person feels is much different than other typical waterbed constructions as the force of the motion from the sleeping person is distributed over a much larger area as a result of the rigid platform 2 that is disposed between the mattress 4 and the bladder 3. As a result, the motion caused by movement of the sleeping person in the apparatus 1 is less severe, has a tendency to dissipate sooner, and is always accompanied by a substantially rigid support from the platform 2 so that the feel and support of the mattress 4 is never compromised by a continually changing shape of its support means.

Figure 4:
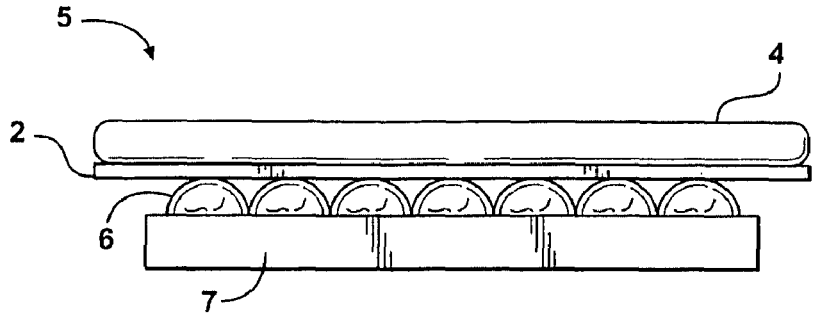
FIG. 4 is a front elevational view of the mattress support apparatus without a frame and with multiple longitudinally arranged tube bladders.
Figure 5:
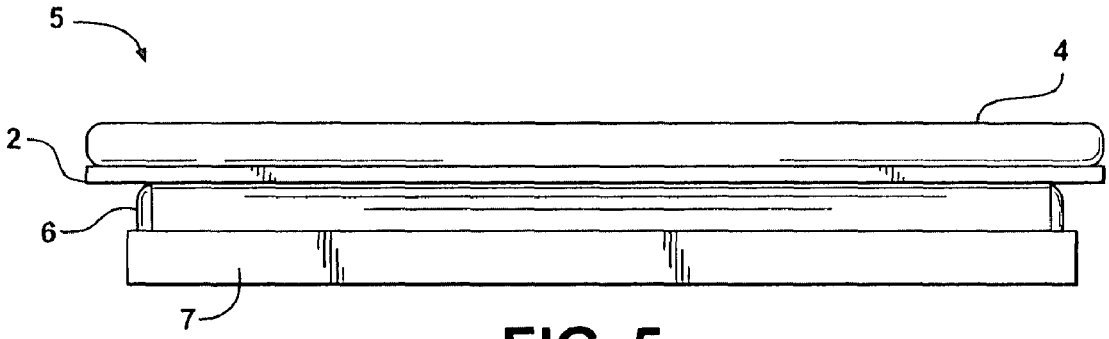
FIG. 5 is a side elevational view of the mattress support apparatus without a frame and with multiple longitudinally arranged tube bladders.
Figure 6:
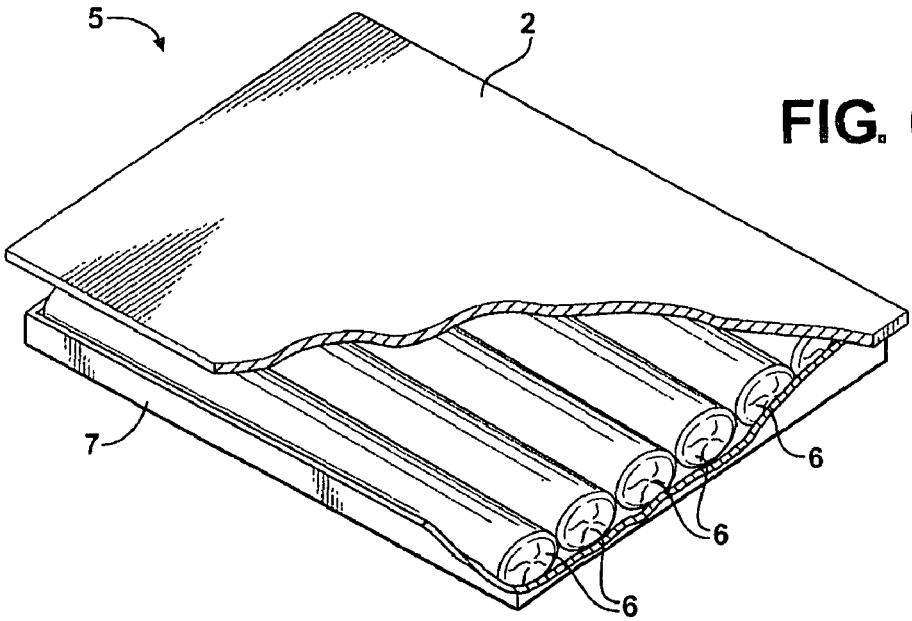
FIG. 6 is a perspective cutaway view of the mattress support apparatus without frame and with multiple longitudinally arranged tube bladders.
Figure 7:
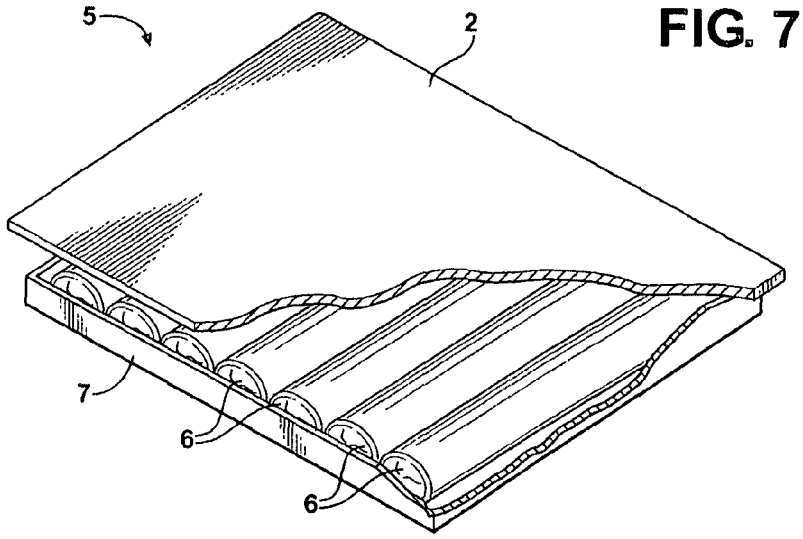
FIG. 7 is a perspective cutaway view of the mattress support apparatus without a frame and with multiple transversely arranged tube bladders.
Figure 8:
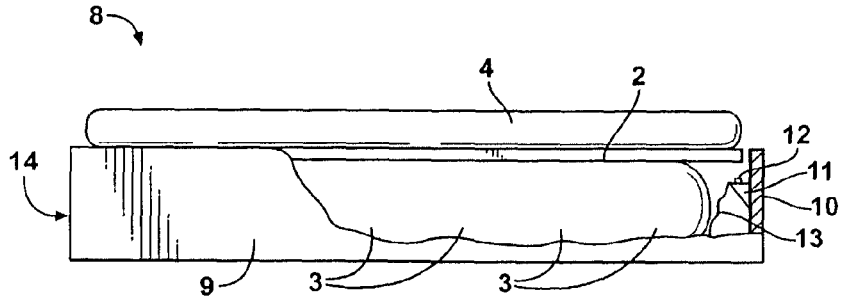
FIG. 8 is a front cutaway view of the mattress support apparatus with a frame and a single bladder.
Figure 9:
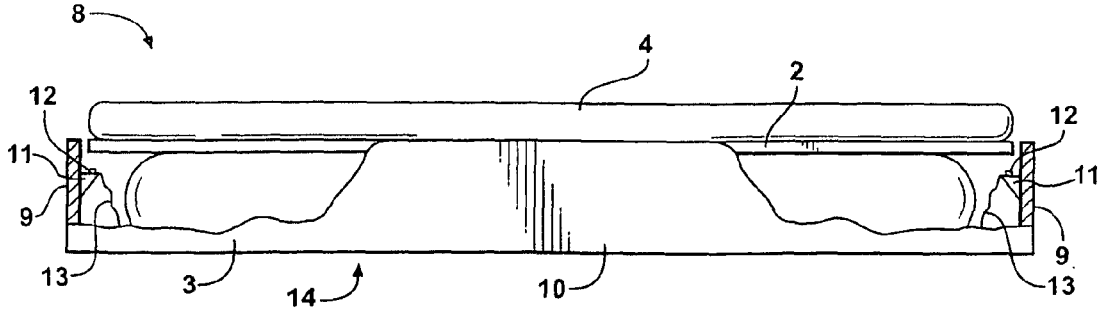
FIG. 9 is a side cutaway view of the mattress support apparatus with a frame and a single bladder.

Referring to FIGS. 4-7, there is depicted another aspect of a bed mattress support apparatus 5. This aspect employs the rigid platform 2 and the mattress 4 that are substantially identical to those described above. Additionally, this apparatus 5 employs the use of a multiplicity of fluid tubes 6 instead of the single bladder 3. These fluid tubes 6 are constructed in a similar fashion and with the same materials as the single bladder 3. Referring to FIGS. 4-6, this aspect depicts longitudinal tubes that extend from near to the first end of the bed to near to the second end. Referring to FIG. 7, this aspect depicts transverse tubes that extend from near to the first side of the bed to near to the second side. It will be understood that in all of the aspects of the apparatus, a single bladder 3, longitudinal tubes 6 or transverse tubes 6 are all possible configurations. Additionally, the bladder 3 or tubes 6 may contain motion limiting devices used to dissipate waves and energy of the moving fluid.

Referring to FIGS. 4-7, there is depicted a frame 7 to constrain the bladder 3 or the fluid tubes 6 and to constrain the bladder 3 or tubes 6 from substantial lateral movement. The frame 7 may be constructed from many different materials including wood, plastic, plasticized wood, fiberglass, carbon fiber, wood composite fiber, etc. The frame 7 has closed first and second ends, first and second sides, and a bottom, and an open top. The frame 7 provides functionality to contain and position the fluid tubes 6, to contain any spilled fluid from a potentially broken fluid tube 6, and to limit the motion of the platform 2. As the platform 2 moves due to forces such as from movement from or simply the weight of a sleeping person, it is limited and stopped when the motion becomes so great that the bottom of the platform 2 reaches and touches the top of an end or side of the frame 7. Other motion limiting and fluid containment means are possible as will become apparent with the following description of additional aspects.

Referring to FIGS. 8-13, there is depicted another aspect of the bed mattress support apparatus 8 with another means for motion limitation and fluid containment. A bed mattress support apparatus 8 employs a frame 14 that contains the components that make up this type of motion control and fluid containment. The frame 14 has first and second ends 9 adjoined to first and second sides 10. The ends 9 and the sides 10 may be made from many different materials including wood, plastic, fiberboard, particle board, fiberglass, aluminum, steel, other metals, carbon fiber, etc.

Affixed to the ends 9 and the sides 10 are one or a multiplicity of motion limiting stops 11. Typically, there is at least one motion limiting stop 11 on each side 10 and end 9 though many different configurations are possible including the absence of motion limiting stops 11 on a particular side 10 or end 9. The motion limiting stops 11 may be of many different sizes, shapes, such as square, rectangular, wedge-shaped, etc, and of many different materials. The wedge-shaped stops 11 shown by example only.

Affixed to the motion limiting stops 11 is an optional damping material 12. This is employed to dampen the sound and vibration caused when the platform 2 impinges onto the motion limiting stop 11 and to create a "soft stop" arrangement whereby the deceleration to a stopped state of the platform 2 happens more gradually than if the platform impinged onto the motion limiting stop 11 without the damping material 12. The damping material 12 may be made from polyurethane, rubber, latex, thermoplastic elastomer, silicone, cellulous foam, plastic, or other suitable materials. As can be seen in FIGS. 11 and 12, the damping material 12 may be a single piece or a multiplicity of smaller pieces as well as different sizes and shapes. Alternatively, the damping material 12 may be affixed to the platform 2 or to both the platform 2 and the motion limiting stop 11.

Referring to FIG. 10 depicts a variation of this aspect which employs multiple motion limiting stops 11 for each end 9 and side 10. In all of the versions of motion limiting stops 11, the motion limiting stops 11 may optionally be configured to be user adjustable to provide for more or less motion to the liking of the user. The adjustments include the vertical position of the motion limiting stops 11, the amount of damping material 12, and the number of individual damping material segments 12.

This aspect employs a fluid-resistant, leak proof safety liner 13 typically made of flexible polyvinyl chloride film though many other materials are possible including polyethylene, vinyl, polypropylene, and other flexible film waterproof materials. The safety liner 13 is secured at its outer edges to the frame 1A and/or to the motion limiting stops 11. For example, the edges of the safety liner 13 are disposed in between the motion limiting 11 and the damping material 12 and are retained in place by this sandwich like construction.

Figure 15:
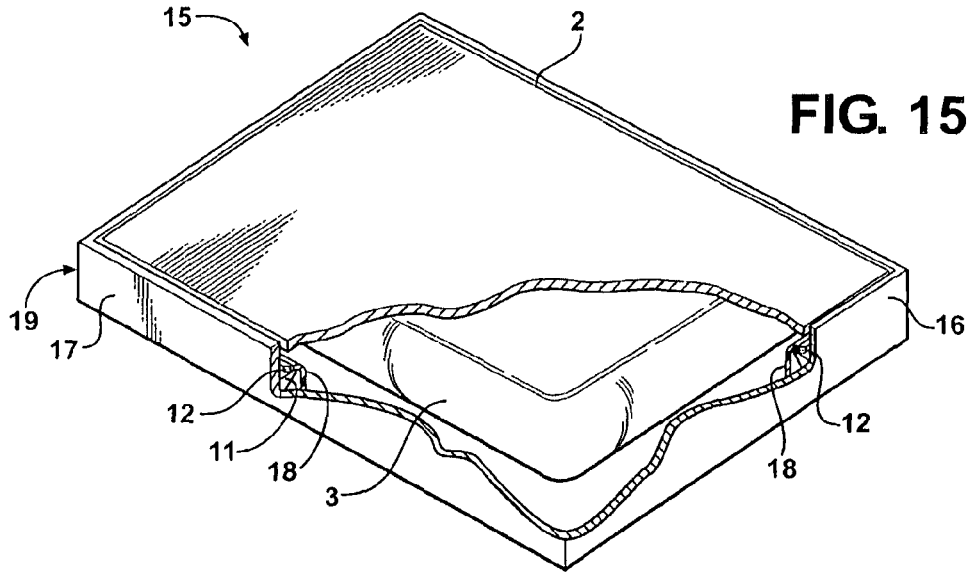
FIG. 15 is a perspective cutaway view of the mattress support apparatus with a single bladder, and a frame with an integrated flood protection tray.

Referring to FIGS. 14 and 15, there is depicted another aspect of motion limitation and fluid containment. The bed mattress support apparatus 15 employs a safety tray 18 onto which the bladder 3 is disposed. The safety tray 18 is rigid or semi-rigid and may be constructed by compression molding plastic. However, many other materials and fabrications means are possible including fiberglass, carbon fiber, plasticized wood or wood fiber materials, etc. The safety tray 18 has a closed bottom and stepped first and second sides and ends. The stepped sides and ends provide a substantially horizontal shelf and a substantially vertical outer side and end. One or a multiplicity of an optional damping material 12 may be affixed to the horizontal shelf.

This aspect also has an optional frame 19 including first and second ends 16 and first and second sides 17. The ends 16 and the sides 17 may be made from many different materials including wood, plastic, fiberboard, particle board, fiberglass, aluminum, steel, other metals, carbon fiber, etc. The ends 16 and sides 17 are affixed to the outer sides and ends of the safety tray 18. Many affixing means are possible including adhesives, rivets, bolt and nut, screws, a friction or slip-on arrangement, etc. Because the sides 17 and ends 16 are removable, this aspect allows many different aesthetic designs that form only the sides 16 and ends 17. This allows for retail stores to have flexibility with stocking options and allows purchasers to change the color or style of their bed without purchasing an entire new assembly 15.

Figure 16:
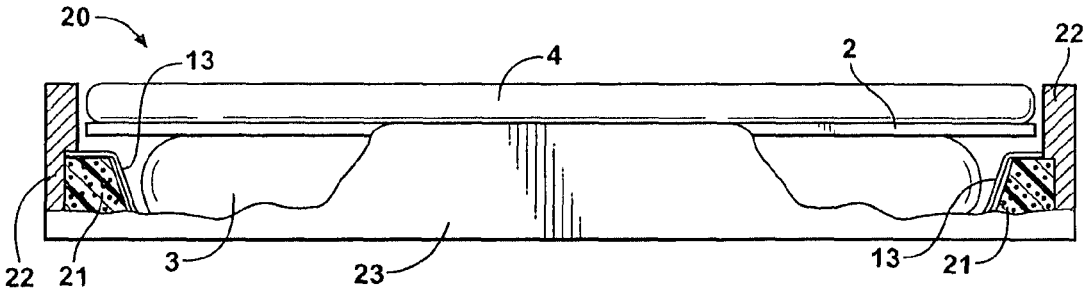
FIG. 16 is a side cutaway view of the mattress support apparatus with a foam style motion limiter, and a single bladder.

Referring to FIG. 16, there is depicted another aspect of a bed mattress support apparatus 20 with another means for motion limitation. A bed mattress support apparatus 20 employs a compressible motion limiting frame 21. The motion limiting frame 21 can be constructed of a cellulous foam material and is formed as a single piece. Alternatively, the motion limiting frame 21 may be fabricated from multiple pieces which are fitted or joined together and may be made from alternative materials including polyurethane, silicone, thermoplastic elastomers, rubber, latex, open-cell foam, closed cell foam, and other compressible materials. Although not shown in FIG. 16, an optional damping material 12 may be affixed to the underside of the platform 2.

The bed mattress support apparatus 20 may include an optional outer frame 22. The outer frame 22 can be a single piece structure that surrounds the motion limiting frame 21. Alternatively, the outer frame 22 may be made from a multiplicity of individual components. The outer frame 22 can be constructed of a fabric covered foam, or other material to give the aesthetic appearance of a typical standard mattress. Alternatively, the outer frame 22 may be constructed from many other materials. The outer frame 22 can also be integrated as part of the compressible foam frame 21 as a single piece, unitary component, or constructed as a stand alone structure separate from the compressible frame 21.

Figure 17:
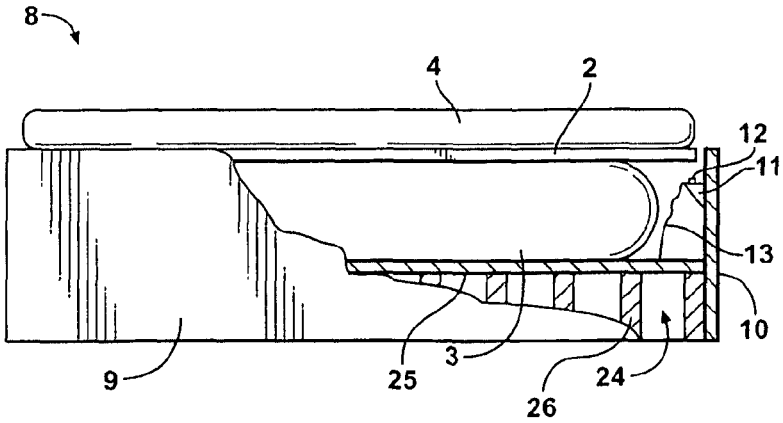
FIG. 17 is a front cutaway view of the mattress support apparatus with a single bladder and frame with a raised bladder platform.

Referring to FIG. 17, there is depicted another aspect of the bed mattress support apparatus with a raised platform or base 25 to support the bladder 3. The bed mattress support apparatus 8 employed in this configuration has a riser assembly 24. The riser assembly 24 includes a substantially rigid platform 25, onto which is disposed the rest of the mattress support apparatus 8, and a multiplicity of longitudinal supports 26. The raised platform 25 may be constructed from plywood, particle board, medium density and other fiberboards, fiberglass, carbon fiber, plastics, steel, aluminum, other metals, and composite sandwich constructions with these same materials combined with any of the same materials or others such as cardboard, honeycomb material, etc. The longitudinal supports 26 may also be constructed of these same materials.

Figure 18:
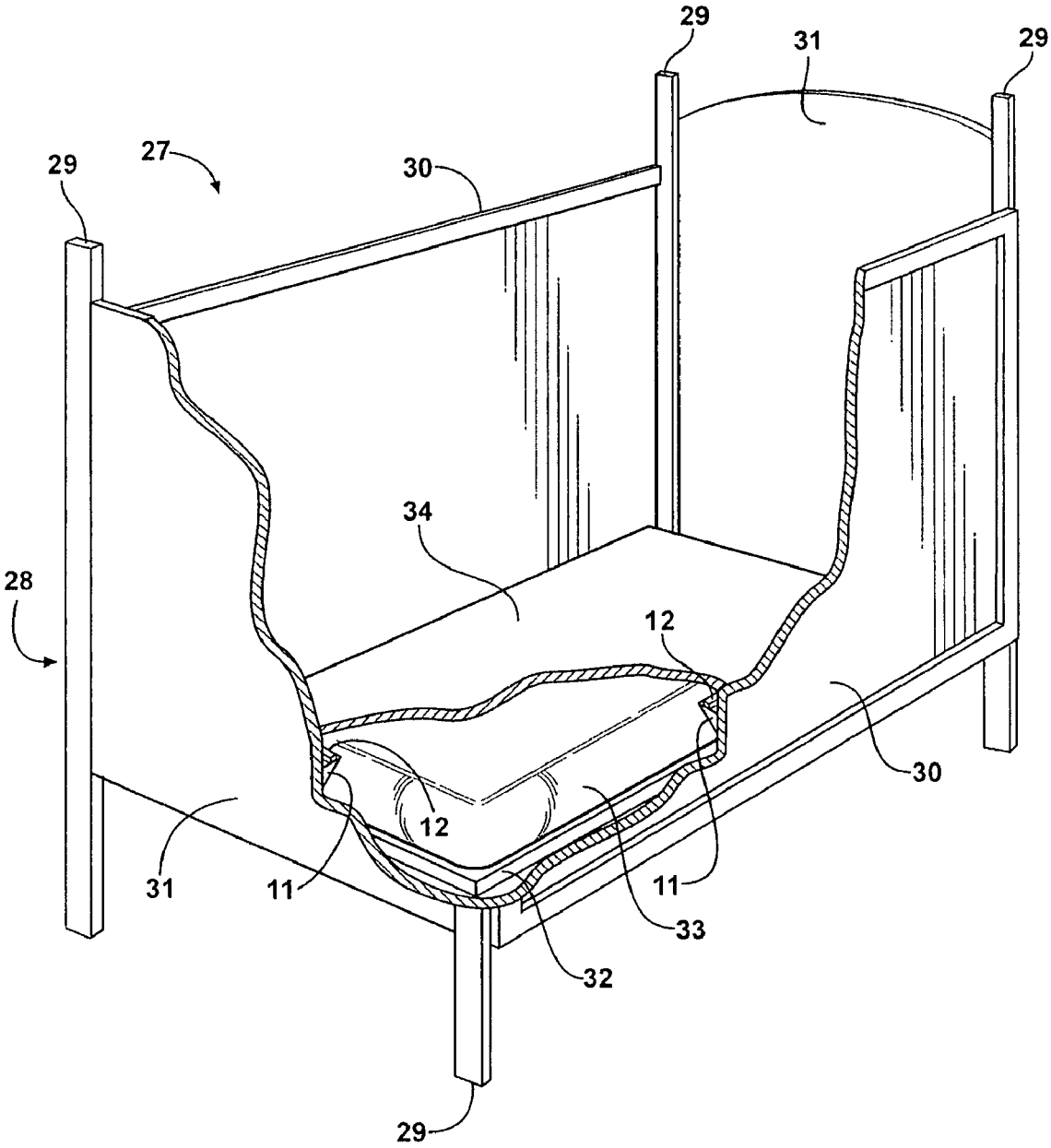
FIG. 18 is a perspective cutaway view of the mattress support apparatus in a child's crib.

Referring to FIG. 18, there is depicted another aspect of the bed mattress support apparatus in which the bed mattress suspension technology previously described is applied to a child crib 27. The crib 27 employs a crib frame 28 to contain the suspension and platform system. The crib frame 28 has a multiplicity of legs 29, first and second sides 30, and first and second ends 31. One of the first or second sides 30 and one of the first or second ends 31 are attached to each of the legs 29. Many different materials including wood, wood fiber, plastics, metals, and others may be used to fabricate the legs 20, the sides 30, and the ends 31. It will be understood that many design configurations exist for these components including configurations where the sides and the ends have openings or are constructed with spindles.

The crib 27 employs a rigid bottom support 32. The rigid bottom support 32 is disposed onto the frame 28 typically in a vertical position above the floor and near the bottom of the ends 31 and the sides 30. The bottom support 32 may be constructed from plywood, particle board, medium density and other fiberboards, fiberglass, carbon fiber, plastics, steel, aluminum, other metals, and composite sandwich constructions with these same materials combined with any of the same materials or others such as cardboard, honeycomb material, etc.

One or a multiplicity of motion limiting stops 11 and optional damping material 12 may be affixed to one of the sides 30 or the ends 31. The motion limiting stops 11 and the damping material 12 are substantially similar to those previously described. Additionally, all of the other aspects of motion limiting and damping material configurations apply to this aspect as well.

A bladder 33 is disposed on the top of the bottom support 32. This bladder 33 is substantially similar to the bladder 3 described previously except that it is configured for the smaller size of the crib 27. Similar to other aspects, the crib 27 may be configured with fluid tubes 6 instead of the bladder 33.

A platform 34 substantially similar to the platform 2 previously described is disposed onto the bladder 33. A mattress, foam pad, pillow, or other soft device, not shown, may optionally be placed over the platform 34.

What is claimed is:

1. A bed comprising:

a fluid-fillable bladder;

a rigid, platform vertically supported on the bladder and adapted to support a cushion;

a frame constraining the bladder from substantial lateral movement; and at least one discrete stop carried by the frame and normally spaced from the platform and adapted to engage the platform only upon movement of the platform to limit vertical movement of the platform to at least one maximum vertical position.

2. The bed of claim 1 wherein:

the platform has sufficient rigidity such that any deflection of the platform caused by the weight of a person on the platform would not be substantially noticeable to the person.

3. The bed of claim 1 wherein:

the platform is adapted to non-compliantly support a cushion.

4. The bed of claim 1 wherein:

the platform is formed as one of a solid platform and a honeycomb platform.

5. The bed of claim 1 wherein:

the platform is formed of at least one of wood, plastic, composite materials, and combinations thereof.

6. The bed of claim 1 wherein:

the bladder is fillable with at least one of air, water, oil, and combinations thereof.

7. The bed of claim 1 wherein:

the bladder is formed of one of a flexible material and a semi-rigid material.

8. The bed of claim 1 wherein the bladder comprises:

at least one fillable chamber.

9. The bed of claim 1 wherein the bladder comprises:

a plurality of fillable chambers.

10. The bed of claim 1 wherein the bladder comprises:

a plurality of individual tubes.

11. The bed of claim 1 further comprising:

a cushion supported by the platform.

12. The bed of claim 11 wherein:

the cushion includes at least one of a mattress, an air mattress, and a compliant pad.

13. The bed of claim 1 wherein the frame comprises:

interconnected frame members forming a rigid, non-moveable structure surrounding the bladder.

14. The bed of claim 1 further comprising:

damping material carried by the at least one stop for damping noise and vibration of the platform during movement of the platform.

15. The bed of claim 1, wherein at least one stop comprises:

at least one wedge carried by the frame.

16. The bed of claim 1 wherein:

the at least one stop is configured to limit vertical downward movement of the platform from a normal non-person supporting position of the platform.

17. The bed of claim 1 wherein:

the at least one stop is configured for limiting vertical upward movement of the platform from a normal non-person supporting position of the platform.

18. The bed of claim 1 wherein:

the at least one stop is configured for limiting vertical displacement of the platform from a normal non-person supporting position of the platform in both vertically upward and downward directions from the normal non-person supporting position.

19. The bed of claim 1 wherein:

the frame is formed of a compressible material.

20. The bed of claim 19 wherein:

at least one of the bladder and the platform interact with the frame to limit vertical displacement of the platform and the bladder relative to the frame when a person is disposed on the platform.

21. The bed of claim 1 further comprising:

a base supported in a vertically spaced position on a floor, the base supporting the bladder.

22. The bed of claim 21 further comprising:

a riser assembly supporting the base in the vertically spaced position on the floor.

23. The bed of claim 1 wherein the frame comprises:

a plurality of interconnected legs and sidewalls defining a crib frame;

the crib frame including a bottom support carried by at least one of the legs and the sidewalls and vertically spaced from a floor, the bottom support carrying the bladder.

24. A bed comprising:

a fluid-fillable bladder;

a rigid, platform vertically supported on the bladder and adapted to support a cushion;

a frame constraining the bladder from substantial lateral movement; and a leak proof tray supporting the bladder within the frame.

25. A bed comprising:

a fluid-fillable bladder;

a rigid, platform vertically support on the bladder and adapted to support a cushion;

a frame constraining the bladder from substantially lateral movement; and a leak proof liner disposed within the frame, the liner surrounding the bladder.

26. A bed comprising:

a fluid-fillable bladder;

a rigid, platform vertically supported on the bladder and adapted to support a cushion;

a frame constraining the bladder from substantial lateral movement;

the frame including a plurality of interconnected legs and sidewalls defining a crib frame and a bottom support carried by at least one of the legs and the sidewalls and vertically spaced from a floor, the bottom support carrying the bladder; and means, carried on at least on of the sidewalls of the crib frame, for limiting vertical movement of the platform and the bladder.

* * * * *